United States Patent [19]

Marshall

[11] 3,949,794

[45] Apr. 13, 1976

[54] WHEEL STAND

[76] Inventor: Don J. Marshall, Box 410, Rte. 6, Edgewater, Md. 21037

[22] Filed: Sept. 4, 1974

[21] Appl. No.: 502,931

[52] U.S. Cl. ..... 144/288 A
[51] Int. Cl.[2] ..... B25H 5/00
[58] Field of Search ..... 157/1.2, 1.24, 1.26, 1.28; 144/288 A

[56] References Cited

UNITED STATES PATENTS

| | | | |
|---|---|---|---|
| 1,752,759 | 4/1930 | Smith | 144/288 A |
| 1,948,434 | 2/1934 | Stafford et al. | 157/1.2 |
| 2,989,098 | 6/1961 | Marshall | 144/288 A |

*Primary Examiner*—Al Lawrence Smith
*Assistant Examiner*—James G. Smith
*Attorney, Agent, or Firm*—William J. Dick

[57] ABSTRACT

A wheel stand for supporting a wheel rim, the stand comprising a base having a hub connected thereto and spaced inwardly and axially from the plane of the base. A plurality of pivots are connected to and spaced about the base and a shaft is mounted in the hub for rotation therein, the shaft including a projecting threaded portion with an actuator nut mounted on the projecting threaded portion for axial reciprocation along the shaft upon rotation thereof. A plurality of rim supports are each connected to a pivot for rotation in a plane perpendicular to the plane of the base, the hub including a plurality of radially projecting arms which are rigidly connected to the nut. A cam is mounted on each of the arms associated with the nut and a cam follower means is mounted on each of the rim support means, each cam and cam follower being coupled in cooperative relationship whereby axial reciprocation of the nut effects rotation of the rim supports about the pivots. Each of the supports includes a radially extending projection having an upwardly extending ear from an inner portion thereof and a notch at the opposite end thereof, the ears forming center-of-rim capture means for a rim having a web and the notches forming rim capture means for open rim type wheels.

The purpose of this abstract is to enable the Public and the Patent Office to determine rapidly the subject matter of the technical disclosure of the application. This abstract is neither intended to define the invention of the application nor is it intended to be limiting as to the scope thereof,

11 Claims, 3 Drawing Figures

WHEEL STAND

SUMMARY OF THE INVENTION AND STATE OF THE PRIOR ART

The present invention relates to wheel stands and more particularly relates to a wheel stand which may be used to handle heavy vehicle wheels having rims both of the open type and rims with webs.

There are numerous examples of tire stands existing in the prior art. For example, in U.S. Pat. No. 2,989,098 issued June 20, 1961 to the present inventor, is illustrated a wheelwright tool or tire stand in which toggle links are provided with a notch at their extended end to grip the rim of a tire, the stand then being inverted so as to elevate the tire from the floor or table so that it may be worked on. Another tire stand is illustrated in U.S. Pat. No. 3,665,989 issued May 30, 1972, also to the present inventor, and shows a tire stand in which a wheel may be quickly elevated from the floor, that tire stand having different lifting and gripping mechanism.

In recent years there have been innovations in the mounting of truck tires on rims and changes in the basic rim structure which while affording a greater margin of safety have created problems with respect to holding the wheel, which includes the tire and rim, while enabling removal of the tire from the rim structure. With either of the aforementioned and above identified prior art tire stands, the type of rim which was adapted to be supported by the stand was the so-called open rim in which the rim comprised an annulus with a large interior opening and the tire is mounted circumscribing the rim. The means for gripping the tire rim so that the wheel could be supported above the floor or other working surface is to grip the rim adjacent its periphery and thereby support the entire wheel above the working surface. With more recent rims, however, while this type of tire stand is still practical, where the rim includes a disk or web which fills in the wheel-rim-well, only those rims which have webs which are recessed with respect to the periphery of the rim and leave enough room for gripping of the periphery by the stand are capable of being employed with those prior art types of tire stands. Moreover, in recent years the web or disk which fills in the rim has been made progressively more protruding and holes which used to be in the web adjacent the interior periphery of the rim have been entirely eliminated except for the one large hole in the center where the axle end passes through. Because of this difference in rim structure, new tire tools have been developed to accommodate those wheels in which the web of the rim is substantially closed with the exception of the center hole. For example in the present inventor's co-pending application Ser. No. 293,313 filed on Sept. 29, 1972, is disclosed an adapter for a portable tire removing tool which is necessitated by the newer closed disk or web type rims.

In view of the above, it is a principal object of the present invention to provide a new and novel wheel stand which is capable of accommodating both closed and open rim wheels.

Another object of this present invention is to provide a wheel stand which is simple to operate and yet of sufficient stability to support a wheel off of a work surface without tipping while an operator is working on the rim and/or tire mounted thereon.

Yet another object of this invention is to provide a wheel stand which is economical in construction and may be manufactured with few moving parts.

Other objects and a more complete understanding of the invention may be had by referring to the following specification and claims taken in conjunction with the accompanying drawings in which:

Figure 1:
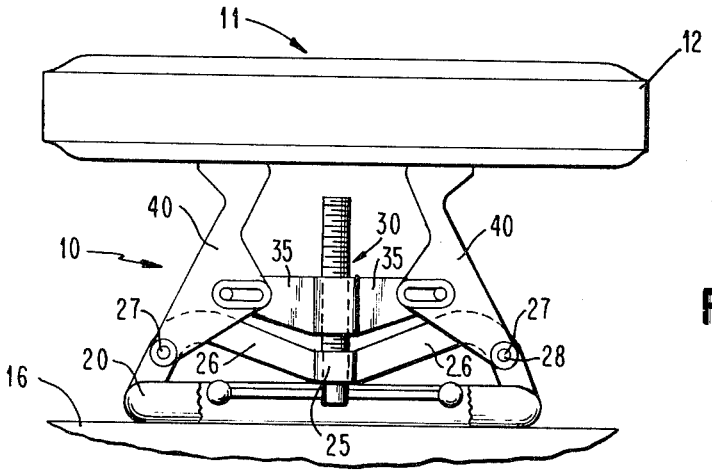
FIG. 1 is a schematic, fragmentary side elevational view showing a wheel stand constructed in accordance with the present invention and supporting a wheel thereon.

Referring now to the drawings, and especially to FIG. 1 thereof, a wheel stand 10 constructed in accordance with the present invention is shown therein supporting a wheel 11. For purposes of definition, the wheel 11 comprises a tire 12 and a rim (not shown in FIG. 1) the rim being of either the open type 13, (illustrated in dotted lines in FIG. 3) or including a web 14 therein substantially closing the periphery of the rim but leaving an enlarged center hole 15 through which the axle end normally passes when the wheel is mounted on a vehicle.

Figure 2:
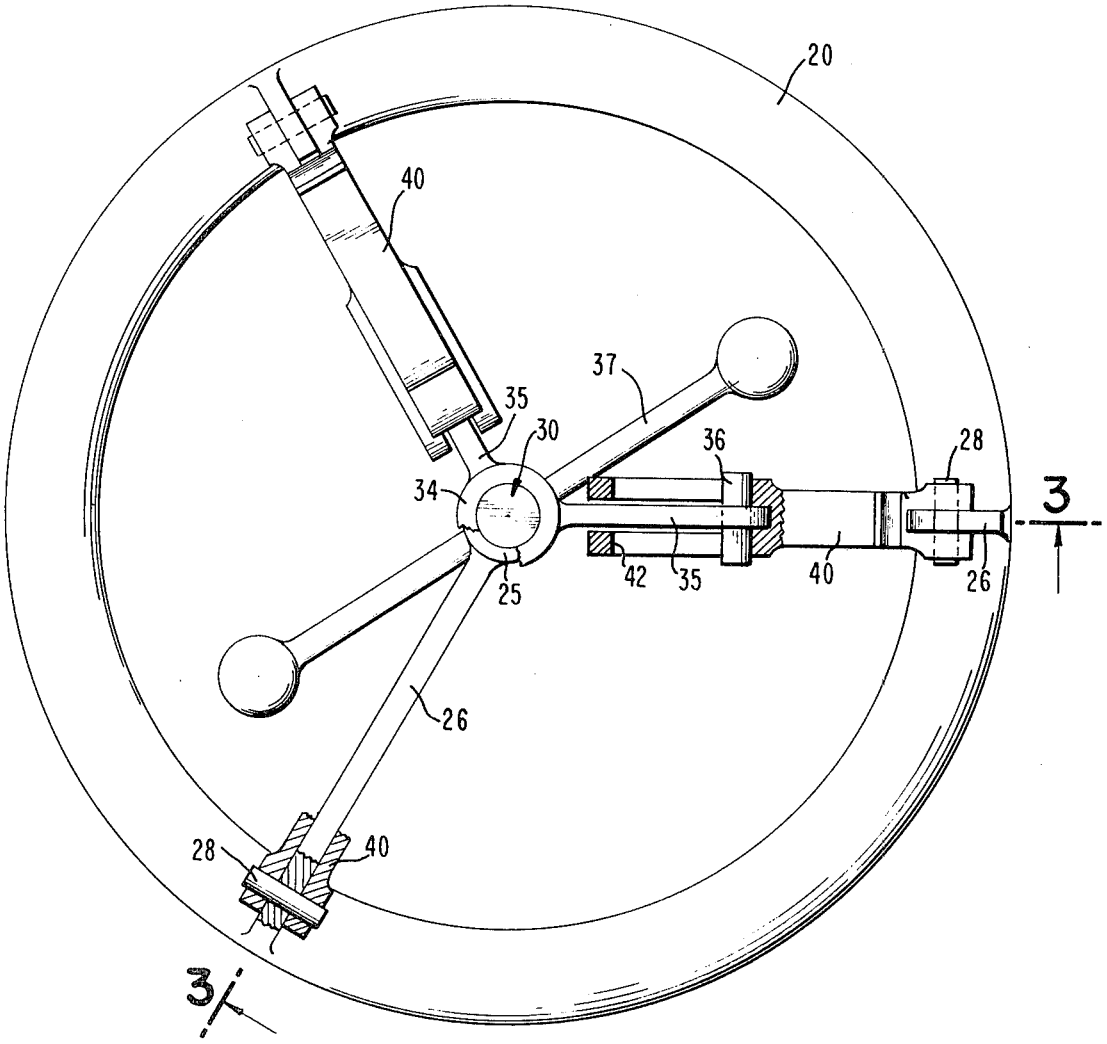
FIG. 2 is an enlarged fragmentary plan view illustrating the wheel stand of the present invention without the wheel mounted thereon.

In accordance with the invention the wheel stand of the present invention is adapted to grasp and support a wheel 11 having either an open rim or rim with web design and support the wheel above the floor or other work supporting surface 16 upon which it is placed. To this end and referring now to FIGS. 1–3, the wheel stand 10 comprises a base 20, in the present instance the base being ring shaped, and includes an annular hub 25 connected thereto as by a plurality of arms 26, the hub being spaced inwardly and perpendicular or axially from the plane of the base 20. Each of the arms 26 is provided with pivot means 27, in the illustrated instance a pin 28 which supports and about which may rotate a plurality of rim support means 40, the pivots and rim support means being arranged so that each support may rotate in a plane substantially perpendicular to the plane of the base 20.

Figure 3:
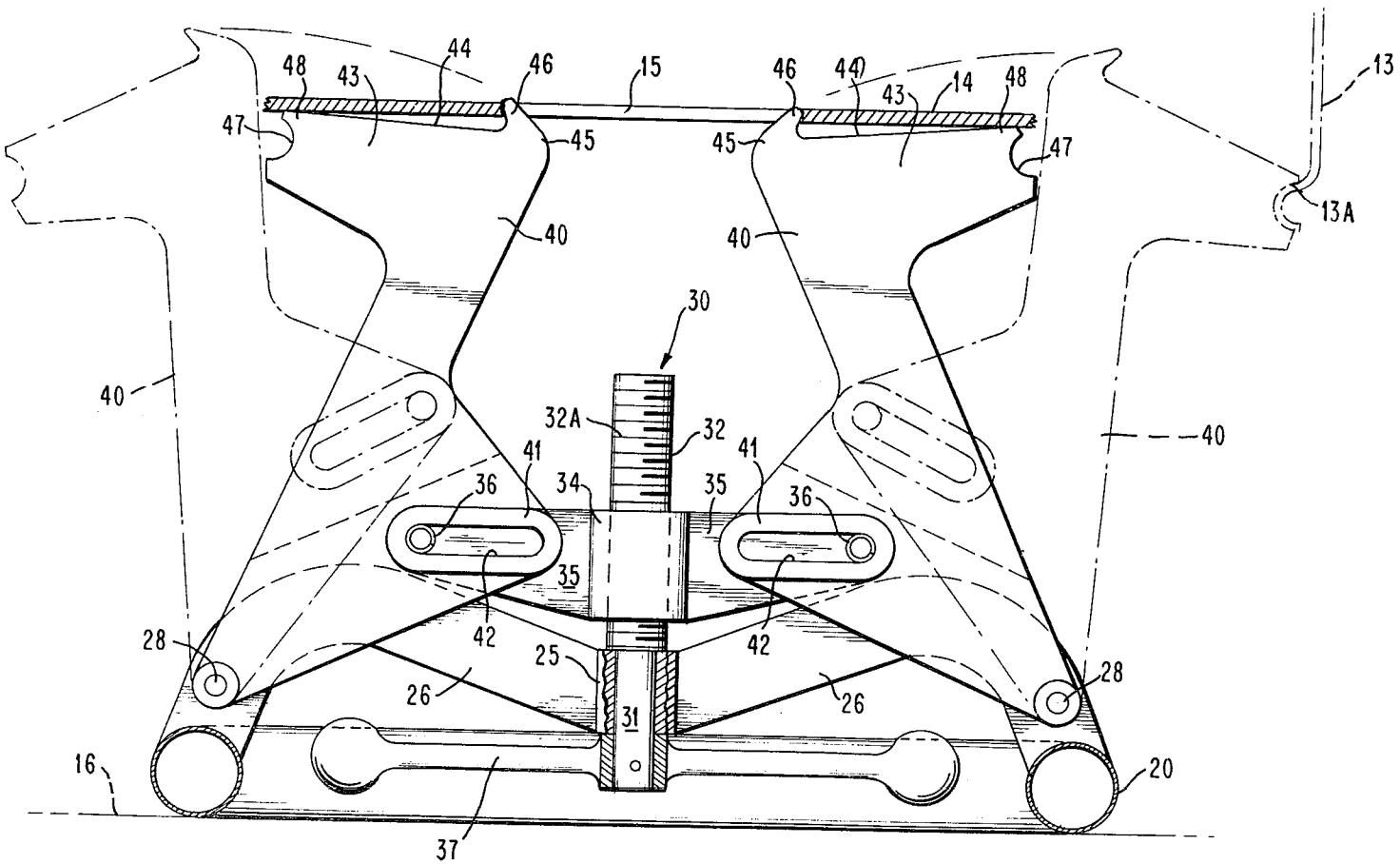
FIG. 3 is a fragmentary sectional view in side elevation illustrating the positioning of the wheel stand of the present invention for supporting wheel rims of two different types.

In order to effect such rotation of the rim support means 40 in a plane substantially perpendicular to the plane of the base, rim support actuator means are provided to support such rotation about the pivot means 27. To this end, and as best illustrated in FIG. 3, the actuator means comprises a shaft 30 having a first portion 31 mounted for rotation in the hub 25, and a second portion 32 which projects vertically from the hub and includes threads or the like 32A. A threaded actuator nut 34 is mounted on the second projecting threaded portion 32 of the shaft 30 for axial reciprocation along the shaft upon rotation thereof. As shown, the actuator nut 34 includes a plurality of radially projecting arms 35, equal in number to the number of rim support means 40, and at the extended ends of each of the arms 35 is a transversely positioned pin 36 which acts, in the present instance, as cam means and which cooperates with cam follower means 41, in the present instance an elongated reinforced slot 42 in the rim support means 40. Thus axial reciprocation of the actuator nut 34 effects vertical reciprocation of the cam 36 on the arms 35 and pivot action of the rim support means 40 about the pivot pins 28 connected to the base 20.

In order to effect such axial reciprocation of the actuator nut 34, the first portion 31 of the shaft 30 includes a driver handle 37 connected thereto which is mounted for rotation within the opening formed by the ring-like base and recessed inwardly of the plane of the work supporting surface 16.

In order to provide rigidity of support for heavy vehicle wheels, and to permit working on the wheel with tire removing tools or the like, each of the rim support means is provided in two identical, but connected together pieces so that the pieces embrace the arms 26 as well as the arms 35 associated with the actuator nut 34. The two piece form of each of the rim support means 40 may best be seen in FIG. 2.

In order to permit the supporting of both the open rim type rim and the rims with webs such as the web 14, alternate gripping or rim capture means are provided on each of the rim support means 40. To this end, and referring now to FIG. 2, each of the rim supporting means 40 includes an upper end 43 which includes a radially extending projection 44 including an upstanding or upwardly extending hook-shaped ear 46 from the inner end 45 thereof and an outwardly facing notch 47 at the opposite end of the radially extending projection 44. As shown, the ears 46 form capture means adapted to engage the periphery of the center hole 15 of the web 14 of the rim, while the notches 47 serve a like function for capturing the peripheral edge 13A of open rim type wheel rims.

In addition, when the wheel stand of the present invention is being used on web type rims, and the ears 46 grip the peripheral edge of the center hole 15 of the web, the projection 44 serves as additional support for the web as at 48 thus providing two point support for each of the rim support means.

In practice when the tire stand of the present invention is used, the wheel is placed on a flat surface, the rim support means are placed over the rim in an upside down or inverted relationship from that illustrated in FIGS. 1 and 3, and the handle 37 is spun until either the notches 47 or the ears 46 engage the rim, depending upon the type of rim. By grasping the base 20, the operator may comfortably tilt or roll the wheel 11 and invert the entire assembly to the position shown in FIGS. 1 and 3 for working on the wheel.

Thus the wheel stand of the present invention provides means for effectively gripping and holding a wheel having any of the rims now encountered in the wheelwright industry.

Although the invention has been described with a certain degree of particularity, it is understood that the present disclosure has been made only be way of example and that numerous changes in the details of construction and the combination and arrangement of parts and the mode of operation may be made without departing from the spirit and the scope of the invention as hereinafter claimed.

What is claimed is:

1. A wheel stand for grasping and supporting the rim of a wheel, said stand comprising: a base having a hub connected thereto; a plurality of rim grasp and support means pivotally connected to said base for pivotal rotation in a plane perpendicular to the plane of the base; actuator means coupled through said hub to said rim grasp and support means for effecting rotation of said support means about said pivots; each of said grasp and support means including a radially extending projection and an upwardly extending ear at the inner end thereof; an outwardly facing notch in said radially extending projection at the radial outer terminal end thereof; said ears adapted to engage and grasp the periphery of the center hole of the web of a wheel, and said notches adapted to engage and grasp the peripheral edge of the rim of open rim type wheels.

2. A wheel stand in accordance with claim 1 wherein said actuator means comprises a shaft mounted for rotation in said hub; means mounted on said shaft for axial reciprocation upon motion of said shaft; a plurality of cam means and cam follower means; one of said cam means and cam follower means connected to said support means and the other of said cam means and cam follower means connected to said first mentioned means on said shaft.

3. A wheel stand in accordance with claim 2 wherein said cam means comprises a pin, and said cam follower means comprises a slot.

4. A wheel stand in accordance with claim 2 wherein said shaft includes a first portion mounted for rotation in said hub, and a second threaded portion projecting from said hub and substantially perpendicular to the plane of said base, and said means mounted for axial reciprocation on said shaft comprises a nut.

5. A wheel stand in accordance with claim 4 wherein said nut includes radially extending arms, said cam means being on said arms and said cam follower means being on said rim support means.

6. A wheel stand in accordance with claim 5 wherein said cam means comprises a pin and said cam follower means comprises a slot.

7. A wheel stand in accordance with claim 6 wherein said base comprises a ring, and a plurality of arms connecting said hub to said ring.

8. A wheel stand for supporting a rim of a wheel, said stand comprising: a base having a hub connected thereto and spaced inwardly and axially from the plane thereof; a plurality of pivot means connected to and spaced about said base, a shaft having a first portion mounted for rotation in said hub and a second projecting threaded portion; a plurality of rim support means connected to said pivot means for rotation in a plane perpendicular to the plane of said base, an actuator nut mounted on said second projecting threaded portion of said shaft for axial reciprocation along said shaft upon rotation thereof; a plurality of radially projecting arms rigidly connected to said nut; cam means on each of one of said arms and rim support means and cam follower means on the other of said arm and rim support means; said cam and said cam follower means coupled in cooperative relationship whereby axial reciprocation of said nut effects rotation of said support means about said pivot means; each of said support means including a radially extending projection having an upwardly extending ear from one portion thereof and a radially and outwardly facing notch at the extended radial end thereof, said ears forming center-of-rim capture means for the web of a wheel and said notches forming rim capture means for open rim type wheels.

9. A wheel stand in accordance with claim 8 wherein each of said upwardly extending ears is hook-like in profile.

10. A wheel stand in accordance with claim 8 wherein said cam means comprises a pin and said cam follower means comprises a slot.

11. A wheel stand in accordance with claim 10 wherein said pin is on said arms and said slot is in said rim support means.

* * * * *